United States Patent [19]

Arnold

[11] 4,279,085

[45] Jul. 21, 1981

[54] EXCAVATING BUCKETS

[75] Inventor: Carroll H. Arnold, Westminster, Mass.

[73] Assignee: Wain-Roy, Inc., Hubbardston, Mass.

[21] Appl. No.: 129,489

[22] Filed: Mar. 10, 1980

[51] Int. Cl.[3] ..... E02F 3/76

[52] U.S. Cl. ..... 37/103; 37/117.5; 37/141 T; 172/699

[58] Field of Search ..... 37/103, 117.5, 118, 37/141 R, 141 T, DIG. 3; 172/699

[56] References Cited

U.S. PATENT DOCUMENTS

| | | | |
|---|---|---|---|
| 740,165 | 9/1903 | Musso | 37/118 R |
| 1,659,768 | 2/1928 | Dietrich | 37/118 R X |
| 2,660,323 | 11/1953 | Carlesimo | 37/141 T |
| 3,471,950 | 10/1969 | Ferwerda | 37/103 X |
| 3,724,899 | 4/1973 | Clark | 37/117.5 X |
| 3,767,070 | 10/1973 | Arnold | 37/117.5 X |
| 3,854,608 | 12/1974 | Arnold | 37/117.5 X |
| 4,037,337 | 7/1977 | Hemphill | 37/141 T X |
| 4,038,766 | 8/1977 | Felstet | 37/117.5 X |
| 4,041,624 | 8/1977 | Fryrear | 37/117.5 |
| 4,204,348 | 5/1980 | Lydie | 37/117.5 |

FOREIGN PATENT DOCUMENTS

| | | | |
|---|---|---|---|
| 596392 | 3/1978 | Switzerland | 37/103 |
| 306228 | 9/1971 | U.S.S.R. | 37/141 R |
| 682605 | 8/1979 | U.S.S.R. | 37/141 T |

OTHER PUBLICATIONS

H&L Tooth Company Sales Manual, "Backhoe Bucket Ripper", Data Section 12, Mar. 1971, p. RH-1, p. 7.

*Primary Examiner*—E. H. Eickholt

[57] ABSTRACT

An excavating device having a plurality of gouging members protruding downwardly from the bottom of an excavating bucket, and extending therefrom in the direction toward the bucket's scooping edge, the members being staggered at varying distances from the edge and bucket sides.

11 Claims, 5 Drawing Figures

FIG 1
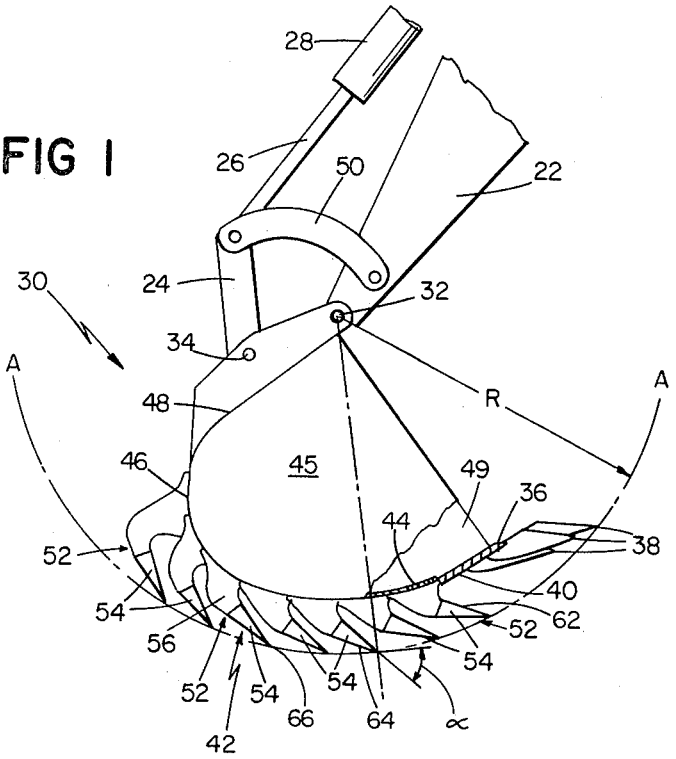
FIG 2
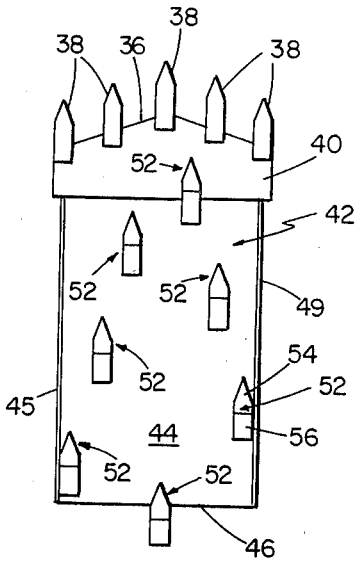
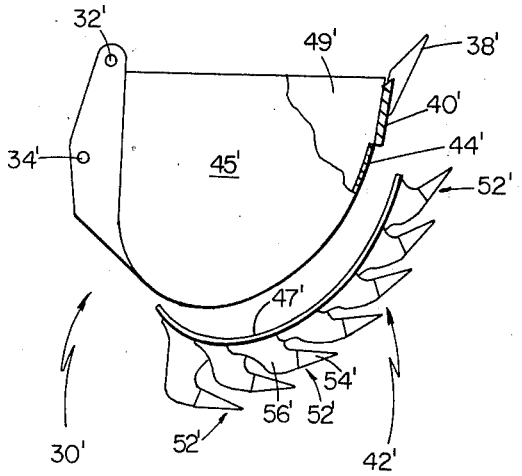
FIG 3
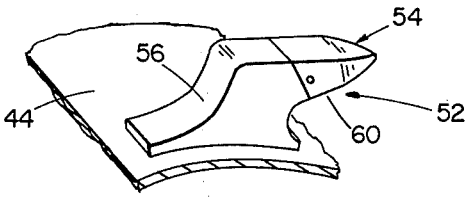
FIG 4
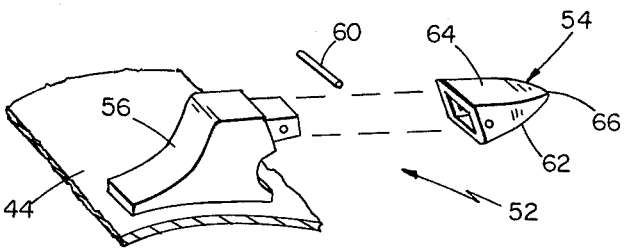
FIG 5

EXCAVATING BUCKETS

BACKGROUND OF THE INVENTION

This invention relates to excavating buckets.

Excavating buckets, such as those used on apparatus commonly known as a backhoe, are usually pivotally attached to a movable dipperstick, with separate actuators arranged to power bucket pivoting and dipperstick movements, respectively. Such buckets often have teeth-like protrusions along a leading edge which loosen and scoop material as the bucket moves through the substrate to be excavated; and may also include a row of ripper teeth attached to the rear of the bucket (i.e., on the side opposite the leading edge) generally parallel to the leading edge and perpendicular to the direction of the motion of the bucket for dislodging and breaking up tightly compacted substrate. Such ripper teeth are usually arranged to operate with the bucket actuator fixed in a fully extended position, and the ripping motion is powered by the dipperstick actuator.

Such ripper teeth have not been entirely satisfactory. They often penetrate too deeply and tend to "stall out" the dipperstick cylinder. Additionally, the material loosened has a tendency to jam the motion of the bucket and cause it to ride over the material and thus reduce ripping penetration; and efficiency of operation is hindered by the need constantly to reposition the bucket to maintain the proper ripper tooth cutting angle.

It is an object of the present invention to maximize ripping effectiveness while at the same time overcoming the above limitations.

SUMMARY OF THE INVENTION

I have discovered that, by providing a plurality of rippers which protrude downwardly from the bottom of an excavating bucket and face towards its front edge, the rippers being staggered from the front edge to the back of the bucket at varying distances from the bucket sides, powered movement of the bucket through a substrate will dislodge pieces without generating drag to stall the bucket's movement. The rippers can be permanently fixed to the bucket bottom or can be part of an adapter which itself may be attached to a bucket.

In preferred embodiments the rippers are not aligned with each other either transversely or longitudinally of the bucket, but are equally spaced front to rear in a V-pattern with the forward cutting edges of the rippers all lying the same distance from the axis of pivotal connection of the bucket to the dipperstick. All rippers are designed to maintain the optimum cutting angle (generally 35°–55° and, preferably, 45°) and for any ripper the clearance between its tooth and the bottom of bucket is greater than in the case of the rippers forward of it.

DESCRIPTION OF THE PREFERRED EMBODIMENT

We turn now to the preferred embodiments of the invention, first briefly describing the drawings.

FIG. 1 is a side elevation of the bucket, partly broken away.

FIG. 2 is a bottom view of the bucket of FIG. 1.

FIG. 3 is a side elevation of a bucket and attachment therefore, showing another embodiment of the invention.

FIGS. 4 and 5 are detailed views of a tooth used in either of the embodiments of FIG. 1 or FIG. 3.

STRUCTURE

As shown in FIGS. 1 and 2, backhoe bucket 30 is attached to dipperstick 22 with hinge pin 32 and to link member 24 with hinge pin 34. Piston rod 26 connects hydraulic actuator 28 to link member 24, and link 50 connects member 24 and dipperstick 22. Leading or scooping edge 36 of bucket 30 has five forwardly disposed teeth 38, extending from forward-pointing, "V"-shaped cutting plate 40.

Bucket 30 has curved bottom plate 42, connecting two side walls 45 and 49 and forming both the bottom 44 and back 46 of the bucket, and a top plate 48. Seven rippers 52 are attached to bottom plate 42, staggered at regular intervals from bucket scooping edge 36 to the rear of plate 42. The forward six of ripper 52 are arranged in a V-configuration, with the center one of teeth 38 on edge 36 forming the apex of the V, and the rippers 52 at the rear of the V close to the bucket sides. The rear most ripper 52 is not part of the V, but is aligned with center tooth 38. As shown in FIG. 2, no two rippers 52 are aligned with each other, either from side-to-side or from front to back of bucket 30. Also, as shown in FIG. 1, the clearance between each ripper 52 and the bottom 44 of the bucket progressively increases from front to rear of the bucket.

Referring now to FIGS. 4 and 5, each ripper 52 includes a shank 56 fixed to the bucket bottom 44, and a ripper tooth 54 fitted over the end of the shank and held in place by a pin 60.

Each tooth 54 includes relatively inclined upper and lower surfaces, 62, 64 respectively, which meet in a point 66 at the front of the tooth. The points 66 of all of rippers 52 are equidistant from the hinge pin 32 about which bucket 30 rotates relative to dipperstick 22, as illustrated by arc A of radius R. As shown, the center one of teeth 38 also lies on arc A. The upper surface 62 of each tooth 54 defines the tooth cutting angle, $\alpha$, which, for each of rippers 52, is between about 35° and 55° and, preferably, 45°. The lower surface 64 is positioned so that it will not bottom-out in the trench cut by the tooth as the bucket is pivoted about hinge pin 32. The progressively greater clearance (front to rear) between the rippers and bucket bottom 42 is provided by, as shown, a progressive increase in the length of shanks 56.

FIG. 3 shows an alternative embodiment of the invention in which plate 47' is welded or bolted to the bottom digging surface 44' of bucket 30'. Rippers 52' are attached to plate 45' and are identical to the rippers 52 of bucket 30, except that, depending on the curvature of surface 44' of a particular bucket, the arc corresponding to A does not necessarily have a constant radius. In any event, however, the arangement of progressively longer shanks and staggering of teeth with respect to edge 36 and the bucket sidewalls remains the same.

OPERATION

Actuator 28 (the bucket cylinder) pivots the bucket about hinge pin 32 (the bucket's axis of attachment to dipperstick 22) causing the bucket to scoop loose substrate with the scooping edge and teeth and to rip compact substrate with the rippers 52. It is also possible to rip by moving dipperstick 22, but much greater force is generally available from extending the bucket cylinder.

Because rippers 52 are not transversely aligned, they sequentially engage the substrate, permitting each tooth to provide the maximum digging force. The side-to-side staggering of the rippers prevents rocks, frozen earth, etc. from being trapped between adjacent teeth, and the progressively increasing clearance between the rippers and the bucket bottom provides room for material loosened by forward teeth to pass between more rearward teeth and the bucket bottom without forcing the bucket up off the substrate which would disengage the more rearward teeth. The preferred "V" ripper pattern allows a trailing tooth to fracture the substrate into the groove already cut by a preceeding tooth. As the bucket 30 is pivoted about hinge pin 32, each tooth cuts at the optimum cutting angle, without requiring adjustment or change in the position of the dipperstick.

The sequential ripping of teeth 54 is at controlled depths, and since all teeth are on a constant radius a flat-bottom trench is cut automatically.

Other Embodiments

In other embodiments the rippers can be arranged to staggered patterns, i.e., patterns in which they do not align transversely or longitudinally, other than the "V"; the rippers may be bolted in place; the front edge of the bucket can be straight rather than "V" shaped; the teeth on the front edge can have other configurations such as flat or bifurcated; and, as noted with respect to FIG. 3, the radius on which the teeth are mounted may increase or decrease from front to rear of the bucket rather than remaining constant. These and other embodiments will be within the scope of the following claims.

What is claimed is:

1. In an excavating bucket including two sides and a curved bottom connecting said sides, said bottom having a front scooping edge, that improvement comprising:

a plurality of rippers protruding downwardly from said bottom and facing towards said scooping edge, said rippers being staggered at varying distances from said edge towards the back of said bucket and at varying distances from the sides of said bucket.

2. The bucket of claim 1 wherein said rippers are spaced at regular intervals from said edge.

3. The bucket of claim 1 wherein at least the majority of said rippers do not align with each other either transversely or longitudinally of said bucket.

4. The bucket of claim 1 wherein said rippers are arranged in a V-configuration, with the apex of said V adjacent said scooping edge, and the rippers of said V do not align with each other either transversely or longitudinally of said bucket.

5. The bucket of claim 1 including means defining the axis of rotation of said bucket relative to a dipperstick when said bucket is attached to said dipperstick, wherein each of said rippers defines a cutting edge, and wherein the distances from said axis to each of said ripper cutting edges are the same.

6. The bucket of claim 1 including not less than six of said rippers, at least three of said rippers lying on each side of the longitudinal center line of said bucket.

7. The bucket of claim 1 wherein one of said rippers is positioned adjacent each side of said bucket.

8. The bucket of claim 1 wherein each of said rippers defines a cutting edge and wherein for each of said rippers the distance from the cutting edge thereof to the bucket bottom is greater than the corresponding distance for any ripper more adjacent said scooping edge and less than the corresponding distance for any ripper more distant from said scooping edge.

9. The bucket of claim 1 wherein each of said rippers includes a pair of relatively inclined surfaces defining a cutting edge, the upper one of said surfaces forming a cutting angle in the range of about 35 to 55 degrees and the lower one of said surfaces being arranged to lie above a line extending from the cutting edge of said ripper to the cutting edge of any ripper more distant from said scooping edge.

10. The bucket of any one of claims 1–9 wherein said rippers are attached to a mounting plate, and said mounting plate is attached to the bottom of said bucket.

11. For connection to an excavating bucket of the type including two sides and a curved bottom connecting said sides, a mounting plate adapted for connection to the bottom of said bucket, and a plurality of rippers protruding downwardly from said bottom and facing towards a leading edge thereof, said rippers being staggered at varying distances from the leading edge of said plate towards the trailing edge of said plate and at varying distances from the sides of said plate, and being arranged so that no two of said rippers are aligned either transversely or longitudinally of said plate.

* * * * *